United States Patent [19]

Ishida et al.

[11] Patent Number: 4,592,419

[45] Date of Patent: Jun. 3, 1986

[54] CONDENSER

[75] Inventors: Keizo Ishida; Yoshikuni Ohshima; Toyoyuki Mukaidani; Isao Ōkouchi, all of Hitachi; Kenkichi Izumi, Mito, all of Japan

[73] Assignee: Hitachi, Ltd., Tokyo, Japan

[21] Appl. No.: 577,612

[22] Filed: Feb. 6, 1984

[30] Foreign Application Priority Data

Feb. 7, 1983 [JP] Japan ..... 58-17481

[51] Int. Cl.[4] ..... F28B 3/04

[52] U.S. Cl. ..... 165/112

[58] Field of Search ..... 165/112, 113, 114; 60/688, 690, 692

[56] References Cited

U.S. PATENT DOCUMENTS

| | | | |
|---|---|---|---|
| 1,962,183 | 6/1934 | Ehrhart | 165/112 X |
| 2,756,028 | 7/1956 | Byerley | 165/113 X |
| 3,094,165 | 6/1963 | Droescher | 165/113 |
| 3,151,461 | 10/1964 | Sebald et al. | 165/112 |
| 3,153,329 | 10/1964 | Sebald | 60/692 |

*Primary Examiner*—Albert W. Davis, Jr.
*Assistant Examiner*—Peggy A. Neils
*Attorney, Agent, or Firm*—Antonelli, Terry & Wands

[57] ABSTRACT

A condenser for a steam turbine expels the oxygen-containing gas residing in the condensate passage in the hot well thereof by a scavenging steam. The oxygen-containing gas is expelled by the scavenging gas, which is introduced into the atmosphere in the condensate passage and arranged to flow counter to the condensate flow. The scavenging means includes a steam pipe attached in a vicinity of an outlet of the condensate passage in the hot well, and a valve device provided in the intermediate portion of the steam pipe.

2 Claims, 3 Drawing Figures

CONDENSER

BACKGROUND OF THE INVENTION

The present invention relates to a condenser, and, more particularly to, an improvement in a condenser for steam turbine.

Hitherto, the combined plant, in which a steam turbine is driven by making use of the waste heat from a gas turbine, generally relies on only the deaerating function of a condenser itself, without providing any independent deaerator.

The U.S. Heat Exchange Institute has recommended that the oxygen content in the condensate in the condenser should be 0.03 cc/l. The condenser of the above type requires about one hour until the oxygen content in the condensate reaches 0.03 cc/l under normal starting conditions (i.e., the time required for deaeration).

For a reduction in the time required for starting of the combined plant, it is necessary to improve the deaerating performance of the condenser itself. For this purpose, it is desirable to replace the condensate in the hot well part in the condenser by a deaerated condensate as quickly as possible.

In the condenser for nuclear apparatus, on the other hand, the path, through which the dropping condensate formed in the cooling pipe nest in the condenser flows to reach the outlet of the hot well part, is elongated in order to lengthen the radioactivity attenuation time of the condensate. In addition, the cooling pipe nest and the hot well part in the condenser are divided from each other by means of a partition plate, and a plurality of vertical partition plates are disposed in the hot well part to make the condensate meander in the condensate passage.

Also in the above condenser, however, a high-oxygen content gas resides in the atmosphere above the condensate in the hot well part. Consequently, while the condensate is meandering in the hot well part, oxygen dissolves into the condensate again, resulting in a rise in the oxygen concentration in the condensate, undesirably.

Thus, the condenser requires a considerable time for deaeration of the condensate in the hot well part, and, disadvantageously a long period of time is required for starting of the whole plant.

Accordingly, it is an object of the invention to provide a condenser capable of expelling the the high-oxygen content gas in the atmosphere in the hot well part to scavenge the same thereby allowing a reduction in the time required for deaeration.

It is another object of the invention to provide a condenser capable of preventing oxygen from redissolving into the condensate in the hot well part thereby allowing an improvement in deaeration performance.

To these ends, according to the invention, a scavenging means is provided for effecting scavenging by steam introduced into the atmosphere in the condensate passage in the hot well part. Since the high-oxygen content gas in the atmosphere in the hot well part is expelled by the scavenging means employing steam, it is possible to reduce the time required for deaeration in the condenser. Moreover, the scavenging means prevents the residence of any high-oxygen content gas in the atmosphere in the hot well part; therefore, there is no possibility that oxygen may redissolve into the condensate so that it is possible to improve the deaeration performance of the condenser.

DETAILED DESCRIPTION

An embodiment of the invention will be described hereinunder in which the condenser in accordance with the invention is applied to a combined plant.

Figure 1:
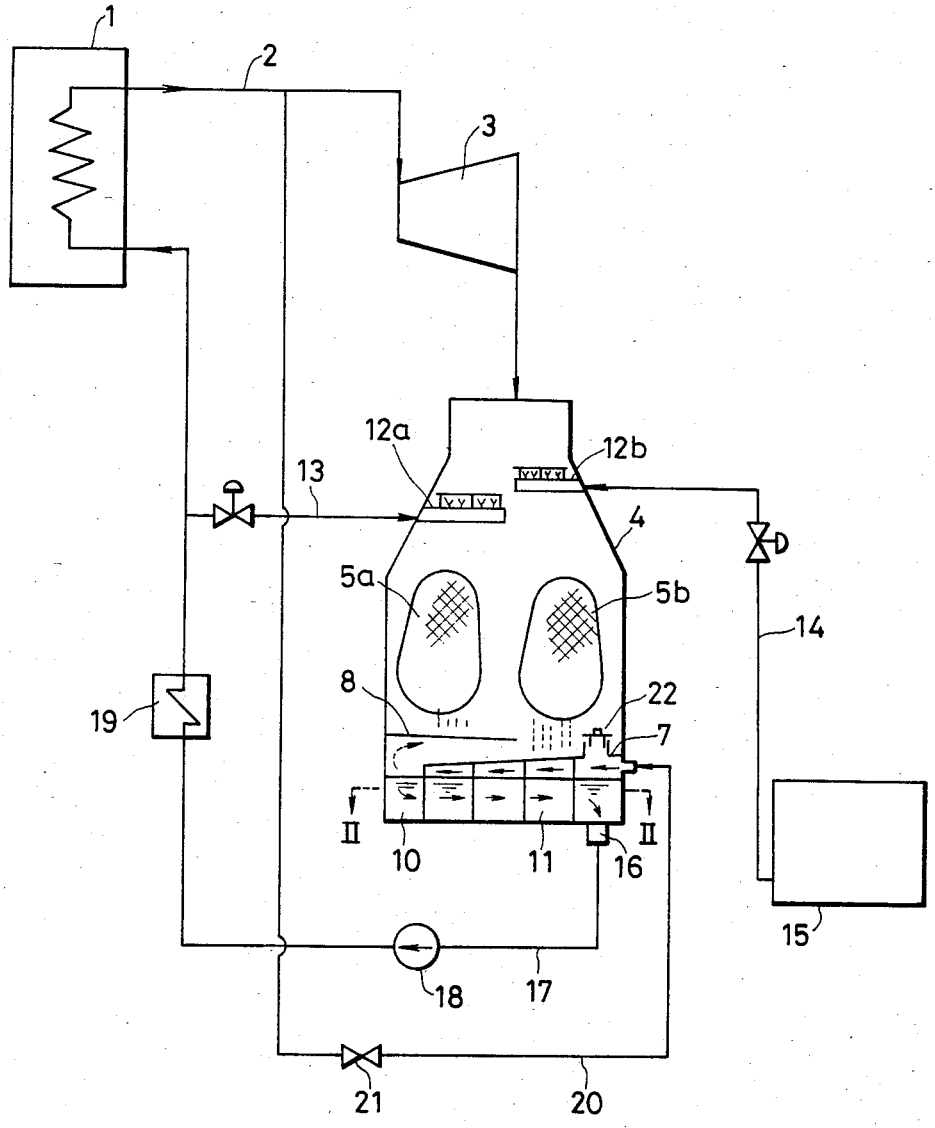
FIG. 1 is a schematic illustration of a combined plant including the condenser in accordance with the invention.

Referring to FIG. 1, the steam generated in a boiler 1 is introduced into a steam turbine 3 through a main steam pipe 2. A condenser 4 is installed under the steam turbine 3. The condenser 4 has therein cooling pipe nests 5*a*, 5*b*, and a hot well part 10 formed in the lower part thereof.

The turbine exhaust from the steam turbine 3 flows into the condenser 4 from the upper side and comes in contact with the cooling pipe nests 5*a*, 5*b* to condense into a dropping condensate.

The condenser 4 has a partition plate 7 for dividing the cooling pipe nests 5*a*, 5*b* and the hot well part 10 from each other. The partition plate 7 is secured to the front wall 4*a*, the right wall 4*b* and the rear wall 4*c* of the condenser 4 so as to be inclined to the left and downwardly, from the right wall 4*b* to the left wall 4*d*. The partition plate 7 covers substantially the whole inside of the condenser 4 except for the left wall 4*d* and vicinity thereof.

An upper plate 8 is provided above the partition plate 7 and under the cooling pipe nest 5*a*. The upper plate 8, confronting the partition plate 7, is secured to the left wall 4*d*, the front wall 4*a* and the rear wall 4*c* of the condenser 4. The upper plate 8 covers nearly the left half of the inside of the condenser 4 and is slightly inclined to the right and downwardly, from the left wall 4*d* to the right wall 4*b*.

The dropping condensate from the cooling pipe nests 5*a*, 5*b* drops onto the upper plate 8 and the partition plate 7 and flows on the partition plate 7 in the form of a thin film-like condensate stream and is then stored in the hot well part 10 as a condensate.

Figure 2:
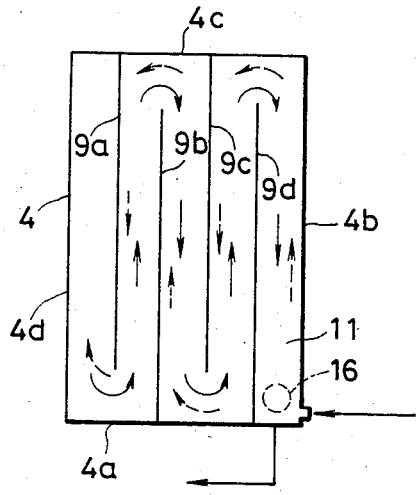
FIG. 2 is a sectional view taken along the line II—II of FIG. 1.
Figure 3:
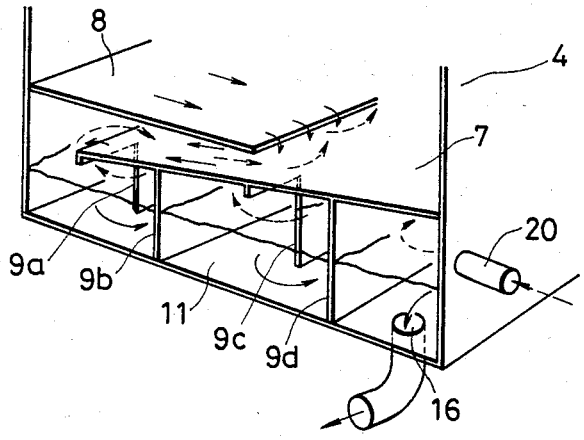
FIG. 3 is a sectional perspective view showing the hot well part of the condenser of the invention and vicinity thereof.

As will be clear from FIGS. 2 and 3, vertical partition plates 9*a*, 9*b*, 9*c* and 9*d* are provided between the bottom surface of the condenser 4 and the partition plate 7. These vertical partition plates 9*a*, 9*b*, 9*c* and 9*d* are integrated with the partition plate 7. The vertical partition plates 9*a*, 9*c* extend from the rear wall 4*c* toward the front wall 4*a* of the condenser 4 at a distance from the front wall 4*a*, while the vertical partition plates 9*b*, 9*d* extend from the front wall 4*a* toward the rear wall 4*c* at a distance from the rear wall 4*c*. The vertical partition plates 9*a*, 9*b*, 9*c* and 9*d* are disposed in parallel to each other to define a meandering condensate passage 11 in the hot well part 10.

The condensate passage 11 in the hot well part 10 consists of a condensate inlet, a condensate outlet 16 and a flow section constituted by a continuous tubular space through which the condensate flows while meandering.

Above the cooling pipe nests 5*a*, 5*b* in the condenser 4, spray devices 12*a*, 12*b* are provided, respectively, to spray water so that it contacts the turbine exhaust introduced into the condenser 4. The spray device 12*a* is connected to a condensate recirculating pipe 13, and the spray device 12*b* to a make-water pipe 14. The make-water pipe 14 is connected to a make-water tank 15.

The condensate flows out from the condensate outlet 16 of the hot well part 10 into a condensate pipe 17. The condensate pipe 17 is provided at its intermediate portion with a condensate pump 18 and a gland-steam condenser 19. The condensate pipe 17 is connected to the inlet of the boiler 1.

An auxiliary steam pipe 20 is arranged to branch off from the main steam pipe 2 and communicate with the atmosphere above the condensate in the hot well part 10 through a scavenging auxiliary steam valve 21. The auxiliary steam pipe 20 is communicated with the upper space in the vicinity of the condensate outlet 16 of the hot well part 10 of the condenser 4.

The auxiliary steam (shown by broken-line arrows) introduced from the auxiliary steam pipe 20 into the atmosphere above the condensate in the hot well part 10 flows counter to the flow of the condensate in the condensate passage 11 in the hot well part 10, that is, in the direction opposite to the direction of flow of the condensate.

The introduction of the scavenging auxiliary steam stream expels a high-oxygen content gas in the atmosphere above the condensate in the meandering condensate passage 11 in the hot well part 10 and prevents the residence of such a gas. Therefore, there is no possibility that oxygen may redissolve into a fresh condensate successively flowing into the hot well part 10.

The auxiliary steam stream is guided by the upper plate 8 covering the upper side of the partition plate 7 so as to flow along the surface of the thin film-like condensate stream while deaerating the thin film-like condensate stream.

As shown in FIG. 1, the partition plate 7 is provided with a gravity cover-type pressure-relieving means 22. The pressure-relieving means 22 is constructed such that an opening, serving as a manhole, is formed in the partition plate 7 and covered with a weight in the shape of a manhole cover.

The pressure-relieving means 22 is adapted to open in order to prevent a rise in pressure when the condensate pump 18 suddenly stops, for example, to cause an abnormal rise in pressure in the space above the condensate in the hot well part 10. Since the pressure-relieving means 22 relieves such an abnormally rising pressure in the space under the partition plate 7 (i.e., the upper space of the hot well part 10) toward the cooling pipe nest 5*b*, there is no possibility of the deformation of the partition plate 7 and an abnormal lowering of the condensate level in the hot well part 10.

In the condenser 4, the time required before the oxygen content reaches 0.03 cc/l was measured with the scavenging auxiliary steam valve 21 opened to supply the scavenging steam stream. The result of the measurement was about fifteen minutes. Thus, it has been confirmed that the application of the condenser of the invention makes it possible to reduce the time required for deaeration to about ¼ of that in the conventional condenser.

As described above, according to the condenser of the invention, the scavenging means, which expels the oxygen-containing gas in the condensate passage in the hot well part by the scavenging steam, is introduced to expel the high-oxygen content gas in the condenser and prevent the residence of such a gas, so that there is no possibility that oxygen may redissolve into the condensate. Thus, it is possible to obtain a condenser improved in deaeration performance and reduced in the time required for deaeration thereby allowing a reduction in the time required for starting of the plant.

What is claimed is:

1. A condenser comprising:

a condenser body;

a cooling pipe nest provided in the upper part inside said condenser body for bringing said steam into contact therewith so that the steam is condensed into a condensate;

a hot well part provided in the lower part inside said condenser body and having a condensate passage including a condensate inlet, a condensate outlet, a flow section, and an oxygen gas containing steam section above said condensate passage;

a member extending substantially over a whole interior of said condenser body provided substantially horizontally between said cooling pipe nest and said hot well part for partitioning said cooling pipe nest and said hot well part from each other;

a plurality of partitioning members integrated with said horizontal partitioning member and provided vertically between the bottom surface of said condenser body and said substantially horizontally extending partitioning member so that a continuous meandering duct is formed by said condenser body, said substantially horizontally extending partitioning member, and said vertical partitioning member;

said flow section of said hot well part is formed within said continuous meandering duct so that the condensate said hot well part flows in a meandering fashion and horizontally in said condensate passage from the condensate inlet to the condensate outlet of said condensate passage;

said oxygen-gas containing steam section of said condensate passage is formed wholly continuously in a meandering fashion above said flow section; and a scavenging means for expelling the oxygen-containing gas in said continuous meandering oxygen-gas containing steam section by steam which is introduced into said continuous meandering oxygen-gas containing steam section in a vicinity of the condensate outlet of said condensate passage and arranged to flow completely in said continuous meandering oxygen-gas containing steam section counter to the direction of flow of the condensate in said condensate passage of said hot well part.

2. A condenser according to claim 1, further comprising:

a plate member extending substantially horizontally guiding the scavenging steam provided above said horizontal partitioning member being a part of said continuous meandering duct, so as to confront the same, whereby the scavenging steam is guided by said guiding member so as to lead into a space between said guiding member and said horizontal partitioning member and flows along a thin film-like condensate steam spread on said horizontal partitioning member counter to a direction of a flow of the thin film-like condensate steam and further flows out toward said cooling pipe nest through the space.

* * * * *